US006247440B1

(12) United States Patent
Gron, Jr.

(10) Patent No.: US 6,247,440 B1
(45) Date of Patent: Jun. 19, 2001

(54) OIL DRAIN TUBE WITH ANNULAR SEAL

(75) Inventor: G. Michael Gron, Jr., Columbus, IN (US)

(73) Assignee: Cummins Engine IP, Inc., Minneapolis, MN (US)

( * ) Notice: Subject to any disclaimer, the term of this patent is extended or adjusted under 35 U.S.C. 154(b) by 0 days.

(21) Appl. No.: 09/300,206

(22) Filed: Apr. 27, 1999

Related U.S. Application Data

(63) Continuation of application No. 08/854,600, filed on May 12, 1997, now abandoned.

(51) Int. Cl.[7] ..... F01M 1/00
(52) U.S. Cl. ..... 123/196 R; 385/344
(58) Field of Search ..... 123/196 R; 285/344

(56) References Cited

U.S. PATENT DOCUMENTS

| | | | |
|---|---|---|---|
| 3,001,804 | 9/1961 | Tomlinson et al. . | |
| 3,064,983 | 11/1962 | Halterman . | |
| 4,066,281 | 1/1978 | De Bonis . | |
| 4,129,503 | 12/1978 | Joseph . | |
| 4,230,530 * | 10/1980 | Lemoine et al. | 202/180 |
| 4,268,046 | 5/1981 | Nisper . | |
| 4,559,782 | 12/1985 | Ritchey et al. . | |
| 4,657,188 | 4/1987 | Crane et al. . | |
| 4,705,303 | 11/1987 | van Aspert . | |
| 5,261,237 | 11/1993 | Benson . | |
| 5,402,643 | 4/1995 | Buchanan et al. . | |
| 5,411,114 | 5/1995 | Bedi et al. . | |

* cited by examiner

*Primary Examiner*—Noah P. Kamen
(74) *Attorney, Agent, or Firm*—Gary M. Gron

(57) ABSTRACT

An engine block in combination with an oil drain tube for allowing oil from a turbocharger to drain back into the engine block includes a substantially cylindrical bore in the engine block into which a portion of the oil drain tube is press fit. The oil drain tube includes an insert portion which establishes a sliding fit with the drain-back bore, an interference fit portion, and an O-ring channel which is positioned between the insert portion and the interference fit portion. An O-ring seal is positioned in the channel and is sized so as to be placed in compressive contact against the inside diameter surface of the engine block bore. Although there is an interference fit between the interference fit portion and the bore, the compressive contact by the O-ring seal establishes a leak-free interface between the bore and the oil drain tube. This allows the oil drain tube to be turned or twisted within the bore without breaking or otherwise losing the leak-free interface.

6 Claims, 2 Drawing Sheets

OIL DRAIN TUBE WITH ANNULAR SEAL

The application is a continuation of Ser. No. 08/854,600 filed May 12, 1997, abandoned.

BACKGROUND OF THE INVENTION

The present invention relates in general to the design and construction of tubing assemblies which are used in closed fluid systems such as those associated with the drain-back of oil into the engine block of an internal combustion engine. More specifically, the present invention relates to the design of a relatively rigid oil drain-back tube for an engine block which is designed for a press fit into a bore in the engine block.

A turbocharged engine requires a steady flow of clean lubricating oil from the engine to the bearings of the turbocharger. It is just as important to return the lubricating oil from the turbocharger to the engine crankcase to ensure that a sufficient supply of oil is available for circulation throughout the engine and turbocharger. A turbocharger oil drain tube provides the conduit for returning the lubricating oil to the engine crankcase.

One style of design for connecting a drain tube to the engine block is to create a receiving bore in the block and a relatively rigid drain tube which is designed to be press fit into the receiving bore. There are though certain problems with this type of design. Typically the drain-back tube has a relatively thin wall and a relatively poor (rough) surface finish, in a microscopic sense, which results in gaps between the bore in the block and the outer diameter surface of the drain-back tube. While the outside diameter of the drain-back tube would appear to be relatively smooth to the touch, the reference to a relatively poor or rough surface finish is more on a microscopic level, but the roughness is still sufficient to result in the creation of various separation gaps. The result of these gaps is the possibility for oil leakage through the press fit region.

While the addition of a sealant at the tube-to-bore interface has in certain cases been tried, the manufacturing sequence is such that the use of sealants which cure quickly are ineffective. In practice, the sealant of choice cures in approximately one minute. However, subsequent to the cure of the sealant, the installed drain tube may need to be turned in the bore in order to orient the other end of the drain tube toward the mating part. The turning or twisting of the drain tube within the bore after the sealant has set up causes the seal to break and the possibility of fluid leakage remains.

The present invention solves the problems of the existing tube-to-block interface by creating a groove in the drain-back tube for receipt of an O-ring seal. On one side of the groove is an insertion portion of the tube which is typically a sliding fit but not a press fit. On the opposite side of the groove is a slightly larger outside diameter which establishes a press fit assembly with the bore in the engine block. The drain tube uses the O-ring seal in combination with the press fit for a leak-free interface. Since a cured sealant is not used, the drain tube is able to be turned or twisted in the bore for aligning the opposite end without losing the leak-free interface. Since the dimensioning of the existing drain tube is substantially unaffected by the modification of adding an O-ring groove, the present tooling which creates the bore in the engine block and the drain tube is substantially the same as before the present invention.

Over the years, various designs for fluid tubes and seals have been invented and the following list of patents is believed to provide a representative sampling of these earlier designs.

| U.S. Pat. No. | PATENTEE | ISSUE DATE |
|---|---|---|
| 3,001,804 | Tomlinson et al. | Sep. 26, 1961 |
| 3,064,983 | Halterman | Nov. 20, 1962 |
| 4,066,281 | De Bonis | Jan. 3, 1978 |
| 4,129,503 | Joseph | Dec. 12, 1978 |
| 4,268,046 | Nisper | May 19, 1981 |
| 4,559,782 | Ritchey et al. | Dec. 24, 1985 |
| 4,657,188 | Crane et al. | Apr. 14, 1987 |
| 4,705,303 | van Aspert | Nov. 10, 1987 |
| 5,261,237 | Benson | Nov. 16, 1993 |
| 5,402,643 | Buchanan et al. | Apr. 4, 1995 |
| 5,411,114 | Bedi et al. | May 2, 1995 |

While a variety of designs are represented by the patents listed above, the claimed invention of the present invention is directed to a structure which is novel and unobvious.

SUMMARY OF THE INVENTION

An engine block in combination with an oil drain tube according to one embodiment of the present invention comprises a substantially cylindrical oil drain-back bore in the engine block and a generally cylindrical oil drain tube which includes an insertion portion, an interference fit portion, and an O-ring channel therebetween. An O-ring seal is positioned in the O-ring channel and is placed in compressive contact with the oil drain-back bore for establishing a leak-free interface between the engine block bore and the oil drain tube.

One object of the present invention is to provide an improved oil drain tube for press fit assembly into an oil drain-back bore of an engine block.

Related objects and advantages of the present invention will be apparent from the following description.

DESCRIPTION OF THE PREFERRED EMBODIMENT

Figure 1:
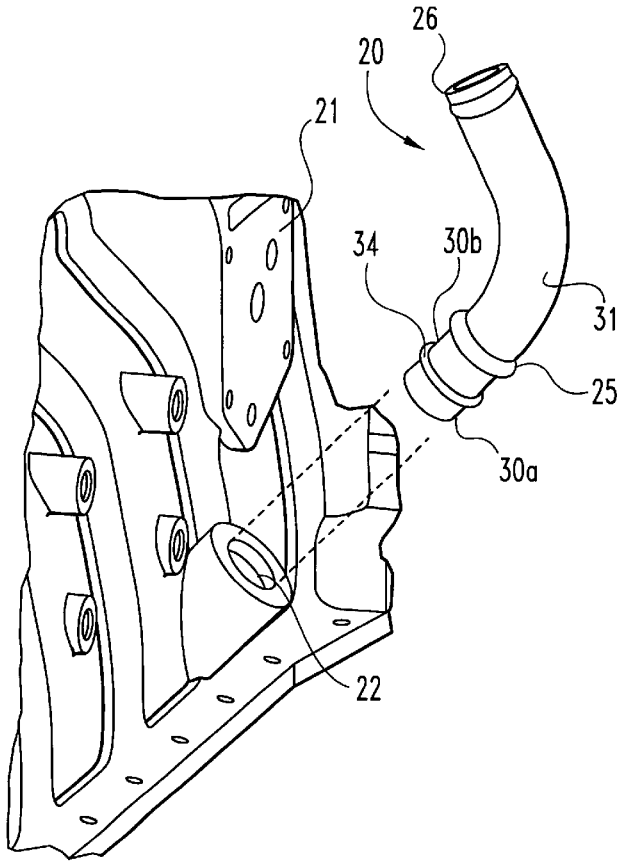
FIG. 1 is an exploded, perspective view of an engine block and oil drain-back tube combination.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
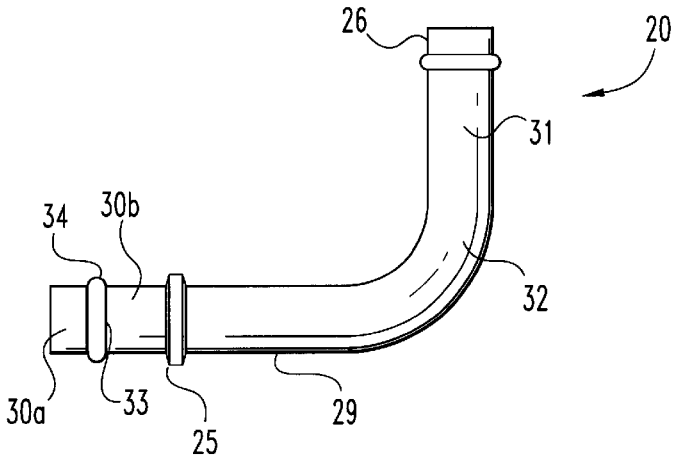
FIG. 2 is a front elevational view of the FIG. 1 oil drain-back tube.

Referring to FIGS. 1 and 2, a rigid, oil drain-back tube 20, as it would be installed in a vehicle engine block 21, is illustrated. The interface between the oil drain-back tube 20 and the substantially cylindrical bore 22 in the engine block 21 is designed to be a sealed interface in order to prevent the leakage of oil between the inside diameter surface of bore 22 and the outside diameter surface of tube 20. The depth of installation of tube 20 into bore 22 is controlled by the location and sizing of annular rib 25. Free end 26 is designed to assemble to a source of oil which drains back into the vehicle engine block 21. A typical source for the oil which drains back into the engine block is a turbocharger. The connection of free end 26 to the source (i.e., turbocharger) may be either a direct connection or an indirect connection by way of an intermediate tube or conduit.

The drain-back tube 20 which is assembled into the engine block 21 is illustrated in greater detail in FIG. 2. Tube 20 includes a tubular body 29, a substantially cylindrical insert portion 30*a*, and a substantially cylindrical press-fit portion 30*b*. Tube 20 further includes a substantially cylindrical connecting portion 31 and a bend portion 32 which is located between the connecting portion 31 and the annular rib 25. The insert portion 30*a* and the press-fit portion 30*b* are separated by annular groove 33. Assembled into annular groove 33 is an O-ring seal 34.

Figure 3:
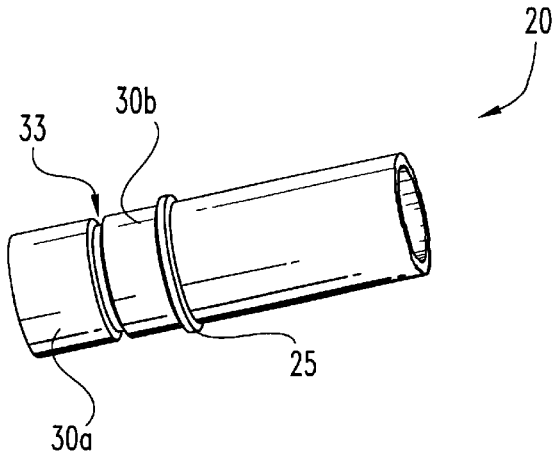
FIG. 3 is a partial front elevational view of the FIG. 2 oil drain-back tube without its O-ring seal.
Figure 4:
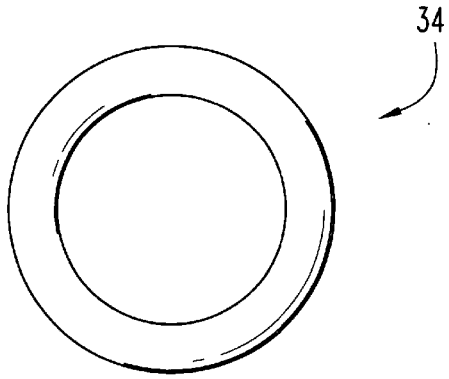
FIG. 4 is a front elevational view of the O-ring seal which comprises one portion of the FIG. 2 oil drain-back tube.
Figure 5:
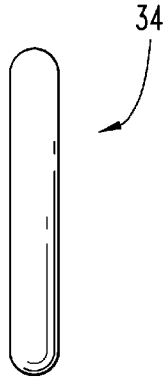
FIG. 5 is a side elevational view of the FIG. 4 O-ring seal.

The outside diameter size of insert portion 30*a* is sized, shaped, and arranged for a close sliding fit into bore 22. The outside diameter size of portion 30*b* is sized, shaped, and arranged for a secure and sealed press-fit into the substantially cylindrical bore 22. As is illustrated in FIG. 3, there is a slight dimensional stagger across groove 33 such that the outside diameter size of portion 30*a* is slightly smaller than the outside diameter size of portion 30*b*, even if their corresponding tolerances are taken into consideration for a "worst case" configuration. The outside diameter size difference on a nominal basis is approximately 0.78 mm or 0.39 mm on a side.

The problem, as described in the Background, is that the thin walled tube which constitutes the press-fit portion 30*b* has a relatively rough surface finish on a microscopic level such that there are in fact tiny gaps between the outside diameter surface of portion 30*b* and the inside diameter surface of bore 22. Even though there is in fact a press-fit, these small gaps can result in oil leakage through the press-fit interface. The addition of the O-ring seal 34 in combination with the designed press-fit of tube 20 into bore 22 is able to achieve a leak-free interface which does not result in oil leakage even if tube 20 must be turned or twisted in order to align free end 26 for its connection to the source of oil.

The depth of annular groove 33 relative to the outside diameter size of the O-ring seal 34 creates an interference fit between the seal 34 and the inside diameter surface of bore 22 which helps to secure the drain tube 20 in bore 22. The resiliency of the elastomeric O-ring seal 34 enables the drain tube 20 to be turned within the bore 22 without losing the sealed interface which has been established between the tube 20 and bore 22. The drain tube can now be turned in order to selectively position the free end in the desired orientation for connection to the source of oil. The O-ring seal 34 in combination with the press-fit of portion 30*b* in bore 22 prevents any oil leakage which might otherwise occur. The position of the O-ring seal 34 provides a barrier against oil leakage while the press-fit portion 30*b* helps to secure the tube in bore 22.

In the preferred embodiment, the outside diameter of portion 30*a* measures approximately 21.7 mm with a size tolerance of ±0.3 mm. The outside diameter size of press-fit portion 30*b* is 22.48 mm with a tolerance of ±0.06 mm. The base of annular groove 34 has a diameter size of 19.66 mm with a tolerance of ±0.06 mm. The elastomeric O-ring seal 34 has an inside diameter size of 18.77 mm with a tolerance of ±0.23 mm. As can be appreciated from the dimensions and tolerances provided, even if the inside diameter of the O-ring seal goes to the larger dimension of 19 mm and even if the diameter of the base of the annular groove goes to the small side of 19.6 mm, there will still be an interference fit which means that the O-ring must be stretched in order to fit around the diameter of the base of the annular groove 33. While the lateral cross-section of the O-ring seal body has a generally circular shape, the diameter of that circular wall section is 1.78 mm which ensures that the outer edge of the O-ring seal will extend slightly beyond the outside diameter size of press-fit portion 30*b*. Additionally, even if the tolerance stack results in the outside edge of the O-ring seal being at its smallest dimension and the size of bore 22 being at its largest dimension, there will still be an interference fit between the O-ring seal and the inside diameter surface of the bore so that there will in fact be compression of the O-ring seal in order to establish a sealed interface. The bore has a nominal inside dimension of 22.35 mm and a tolerance of ±0.03 mm. The tolerance on the wall thickness of the O-ring seal 34 is ±0.08 mm. The interference fit between the bore 22 and portion 30*b* ranges from 0.02 mm on a side to 0.11 mm on a side.

The sides of annular groove 33 have a slight 5 degree taper such that the sides diverge from the base outwardly to the outer surface of portion 30*a* on one side and the outer surface of portion 30*b* on the opposite side. The insert portion 30*a* from its free end inwardly to the edge of annular groove 33 measures approximately 10 mm. The width of the annular groove at its base is approximately 2.36 mm. The dimension from the free end of insert portion 30*a* to the closest edge of annular rib 25 is approximately 25 mm. The width of annular rib 25 measures approximately 3.7 mm.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

an internal combustion engine block defining a substantially cylindrical oil drain-back bore;

a substantially rigid oil drain tube having a substantially cylindrical end insert portion slidingly receivable in said oil drain-back bore, a substantially cylindrical press-fit portion, and an O-ring channel therebetween, said press-fit portion being sized and shaped for establishing an interference fit within said oil drain-back bore and said end insert portion having an outer diameter smaller than said press fit portion; and an O-ring seal positioned in said O-ring channel and radially extending into compressive contact with said oil drain-back bore.

2. The combination of claim 1 wherein the nominal dimension of the bore inside diameter is 22.35 mm and the nominal dimension of the outside diameter of the press-fit portion is 22.48 mm.

3. The combination of claim 2 wherein the interference fit between the press-fit portion and the oil drain-back bore ranges between 0.02 mm on a side and 0.11 mm on a side.

4. The combination of claim 3 wherein said oil drain tube includes an annular stop rib.

5. The combination of claim 1 wherein said oil drain tube includes an annular stop rib.

6. The combination of claim 1 wherein the size range for the outside diameter of the insert portion is between 21.4 and 22.0 mm so as to establish a sliding fit with said oil drain-back bore.

* * * * *